US005689856A

United States Patent [19]

Nauthe et al.

[11] Patent Number: 5,689,856

[45] Date of Patent: Nov. 25, 1997

[54] SWIVELING FLEECE FUNNEL FOR FIBER SLIVER GUIDANCE WITHOUT GUIDING CHANNEL AND PROCESS FOR THE OPERATION OF SAME

[75] Inventors: Alfred Nauthe, Böhmfeld; Wolfgang Göhler, Lenting, both of Germany

[73] Assignee: Rieter Ingolstadt Spinnereimaschinenbau AG, Ingolstadt, Germany

[21] Appl. No.: 622,211

[22] Filed: Mar. 27, 1996

[30] Foreign Application Priority Data

| | | | |
|---|---|---|---|
| Apr. 19, 1995 | [DE] | Germany | 295 06 107.3 |
| Jul. 19, 1995 | [DE] | Germany | 295 11 918.7 |
| Sep. 19, 1995 | [DE] | Germany | 195 35 347.1 |

[51] Int. Cl.[6] ..... D01H 5/72; D01H 13/04; D01G 15/46

[52] U.S. Cl. ..... 19/157; 19/150

[58] Field of Search ..... 19/150, 157

[56] References Cited

U.S. PATENT DOCUMENTS

| | | | |
|---|---|---|---|
| 614,819 | 11/1898 | Albasini | 19/150 X |
| 2,996,873 | 8/1961 | Armstrong | 19/157 X |
| 4,372,010 | 2/1983 | Gauvain . | |
| 4,575,903 | 3/1986 | Gauvain . | |
| 4,763,387 | 8/1988 | Bothner . | |
| 4,922,580 | 5/1990 | Bothner et al. . | |
| 4,949,431 | 8/1990 | Gasser . | |
| 5,016,322 | 5/1991 | Erni et al. | 19/150 |
| 5,412,846 | 5/1995 | Hauner . | |

FOREIGN PATENT DOCUMENTS

| | | | |
|---|---|---|---|
| 801254 | 11/1950 | Germany . | |
| 2623400 | 3/1977 | Germany . | |
| 290679 | 6/1991 | Germany . | |
| 406508 | 3/1934 | United Kingdom | 19/157 |
| 632266 | 11/1949 | United Kingdom . | |
| 786528 | 11/1957 | United Kingdom . | |

*Primary Examiner*—John J. Calvert
*Attorney, Agent, or Firm*—Dority & Manning

[57] ABSTRACT

A fiber sliver guidance system is provided for textile machine drafting equipment wherein a fiber sliver is drafted by pairs of drafting rollers and conveyed by a pair of delivery rollers to a calendar device. The guidance system is disposed between the delivery rollers and the calendar device and includes a plurality of nozzle inserts which define a fiber sliver channel between the delivery rollers and the calendar device. The fiber sliver channel has an axis defined by two axial segments which can be angled relative to each other. At least one of the nozzle inserts can be articulated relative to the other nozzle inserts about a swivel axis. The articulatable nozzle swivels automatically from an operating position to a closed position upon a back-up of fiber fleece in the fiber sliver channel.

14 Claims, 8 Drawing Sheets

$\alpha_B \approx 1°-10°$ $\alpha_A \approx 20°-50°$

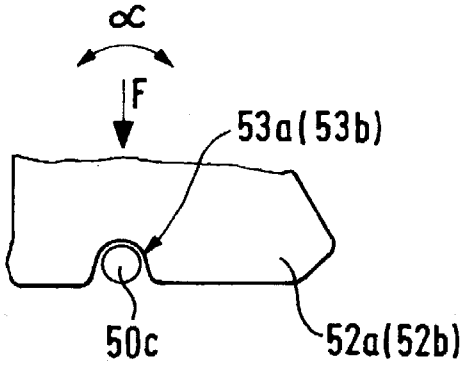
FIG.9A
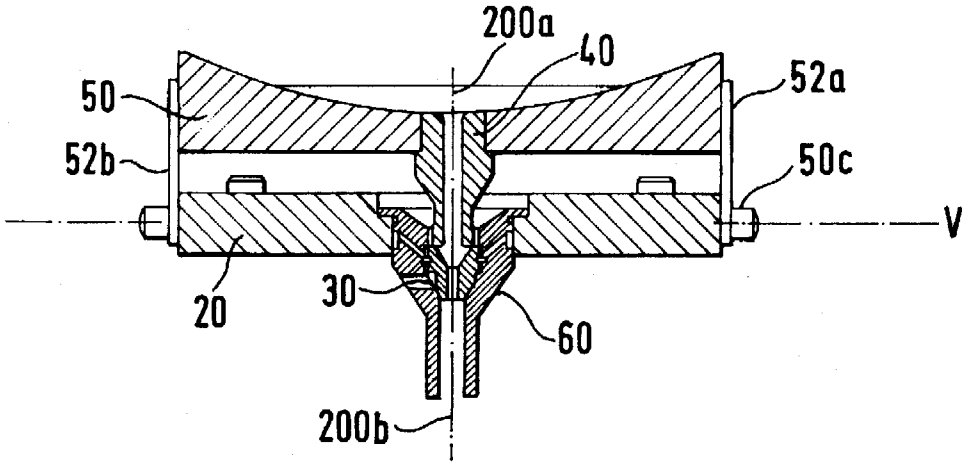
FIG.9B
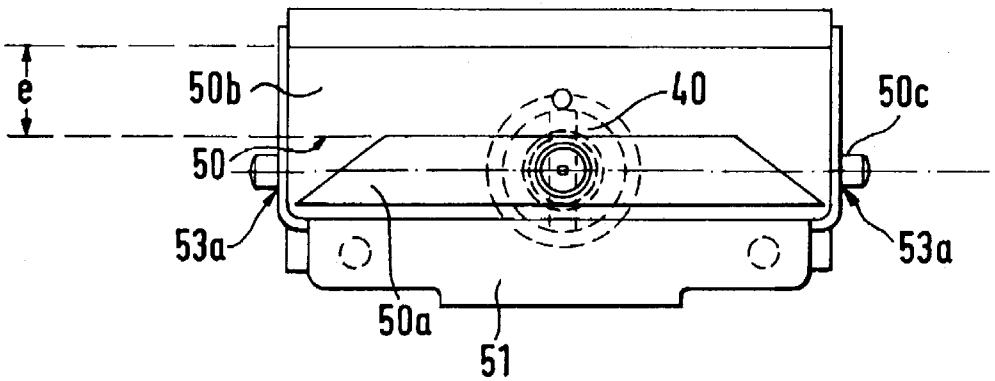

SWIVELING FLEECE FUNNEL FOR FIBER SLIVER GUIDANCE WITHOUT GUIDING CHANNEL AND PROCESS FOR THE OPERATION OF SAME

BACKGROUND OF THE INVENTION

The technical field of the invention is that of textile machines, and particularly a draw frame with a calendar equipment which generally consists of two calendar rollers or calendar disks facing each other by means of which the fiber sliver is compressed. The invention relates to the fiber sliver guidance as well as the guiding nozzles which determine this guidance.

In the state of the art, it is common practice to provide a pair of delivery rollers at the output of drafting equipment of a draw frame (e.g. a fiber sliver processing machine) which convey the fiber fleece into a fleece funnel. Immediately after the pair of delivery rollers the fiber sliver is spread out to the width of the rollers as a result of drafting. The person schooled in the arts calls the spread-out fiber sliver at this location a fiber fleece. The fiber fleece, i.e. the spread-out fiber sliver, is conveyed into the opening of a fleece funnel. The fiber fleece is rolled up and gathered together in the fleece funnel and is conveyed through the funnel outlet to a fiber sliver channel which has a considerable length. At the end of the fiber sliver channel the fiber sliver is guided into a sliver funnel which deflects the direction of movement of the fiber sliver by about 90° and introduces it between a pair of calendar rollers. After going through the pair of calendar rollers the fiber sliver, which is compressed by the calendar rollers, is conveyed on to the depositing device of the draw frame. Such an example is shown in the left half of FIG. 1, where the fiber sliver channel bears reference number 8 and the delivery roller of the draw frame bears reference numbers **70*b* and 70*a***.

EP 593 884A1 also describes is a design with a long fiber sliver channel 8. U.S. Pat. No. 4,372,010 is another example of a long fiber sliver channel (also designated with reference number 8 therein). The pair of calendar rollers in this patent is designated 9*a*, 9*b*.

Another example of the general use of the long fiber sliver channel is shown in DE-A 26 23 400. In this reference, the fiber sliver channel itself is bent at an angle of approximately 90° and guides the fiber sliver without change in angle between the calendar disk designated 5, 6. That patent states that it is advantageous for the channel designated with number 14 to be flattened into an oval shape (see page 9, last paragraph).

A collection is finally also shown in DD 290 679. In this patent, the fleece funnel and sliver funnel are clearly at a distance from each other. A venting opening (designated 8 therein) clearly allows the air which flows in at the beginning of the collection channel (designated 5 therein) to escape completely before the narrowest point of the sliver funnel.

DE-PS 36 12 133 relates to a sliver guiding channel between the output rollers and the calendar rollers on a spinning preparation machine. The sliver guiding channel is designed for the automatic introduction of the beginning of a fiber sliver into a sliver funnel (column 1, lines 9–10). The sliver guiding channel is relatively long and imparts the necessary guidance to the fiber sliver on its way to the sliver funnel. Along that route, several injectors (air channel, compressed-air line) are provided. The total sliver mass is pulled along in the sliver guiding channel by means of injectors. The sliver mass of the beginning of the sliver must then necessarily be compressed in the sliver funnel (column 1, lines 54–58).

A problem of air back-up exists in the sliver funnel (column 1, lines 59–62). In order to eliminate this problem, the sliver funnel must be provided with a device for rapid enlargement of its cross-section. This is a pre-condition for an automatic introduction of the fiber sliver.

Another disadvantage is the fact that the calendar rollers must also be opened for the automatic introduction of the beginning of the fiber sliver. The beginning of the fiber sliver cannot be pulled into the nip of the calendar rollers when the closed calendar rollers are rotating.

OBJECTS AND SUMMARY OF THE INVENTION

It is a principal object of the present invention to reduce the downtime of textile machines due to fleece back-up. Additional objects and advantages of the invention will be set forth in the following description, or may be obvious from the description, or may be learned through practice of the invention.

It is therefore proposed that a swivel axis V extend at a right angle through the fiber sliver guiding channel in order to swivel one of several nozzle inserts along this axis when a fleece back-up occurs in the above-mentioned nozzle insert.

The placement of the swivel axis makes it possible for the back-up pressure of the fed fleece to swivel the first nozzle constituting the fleece funnel automatically from its operating position when the fleece can no longer be moved on, in order to swivel a ramp section of this nozzle into the operating conveying channel which has an inclination, in closed swivel position, that the fleece reaching it (which is still conveyed on) is deflected from the interior of the drafting equipment at a right angle to the normal direction of travel.

The arrangement of the swivel axis results in a very small lever arm at which the fleece conveyed into the fleece funnel attacks and requires only little force to swivel the fleece funnel. The fleece funnel swivels out especially easily in the case of fleece back-up when the swivel axis is located below the fleece funnel and the axis curve K is located in the swivel axis.

The fleece funnel can be designed so that it can be taken out of all its operational positions, in particular however from the swivel position corresponding to the preparation position for threading the fleece as well as from the fleece back-up position. The preparation position or fleece back-up position may be buffered in order to obtain a soft impact in the automatic swivelling.

The buffered swivel capability can also be used manually in order to carry out maintenance or cleaning tasks. For this purpose, a suitable grasping and actuating section on the swiveling nozzle is provided so as to be easily accessible.

The swiveling nozzle (fleece funnel) has a funnel area, as well as an adjoining ramp or plateau area, so that the fiber fleece is formed into a fiber sliver when this nozzle is in operating position by being rolled up, deflected, and gathered together, and so that when the nozzle is tilted, the ramp area ensures that the fiber fleece conveyed to it is deflected in such a manner that it is conveyed out of the deflection zone, does not block the drafting equipment area, and can easily be removed by the operator.

The ramp area also ensures that no fleece back-up can occur because the nozzle then automatically swivels under the force of the fiber fleece conveyed to it and the ramp area deflects the fiber fleece which continues to be conveyed out of the interior of the drafting equipment until the delivery rollers are switched off. This nozzle has at the same time assumed its preparation position in that case, the position which it assumes when a fleece back-up occurs.

The swiveling rectangular nozzle can be supported in the sliver funnel nozzle (a cylindrical-funnel-shaped nozzle) so as to be capable of swiveling over the insert. The swiveling nozzle can however also be supported so as to be able to swivel together with a nozzle section in the form of a sliver funnel adjoining it directly (see FIGS. 9*a*, 8*a*).

The equipment which is free of long down-times is furthermore compact in construction. In spite of the ability to swivel, the effectiveness of the moving air is not lowered.

The compact construction starts directly after the last delivery roller with distinct change in path even before entry into a guiding channel. The additional deflection roller whose axis is slightly above the normal path of the fiber (without deflection roller) and approximately in one plane with the swivel axis V and the calendar nip is able to ensure more than 50° deflection without affecting the fiber straightening property.

The ramp plane of the fleece funnel is determined depending on the impact angles α1, α2 or αA, αB.

In order to enable the fleece funnel to swivel out easily, it is clearly held at a distance from the sliver funnel by spacing plates relative to the overall length of the fiber sliver guidance, yet is installed in its proximity.

Examples of embodiments of the invention are intended to further your understanding.

BRIEF DESCRIPTION OF THE DRAWINGS

FIGS. 9*a* and 9*b* show the fleece funnel 50 with the tilting articulation 50*c* on the stationary holder 20 in which the sliver funnel 60, 30 is detachably held. The forward end 41 of the upper insert 40 can be swivelled in the lower insert 30 of the sliver funnel 60, and for this two articulation surfaces are used which act radially together as air sealants in operating position.

DETAILED DESCRIPTION OF THE PREFERRED EMBODIMENTS

Figure 1:
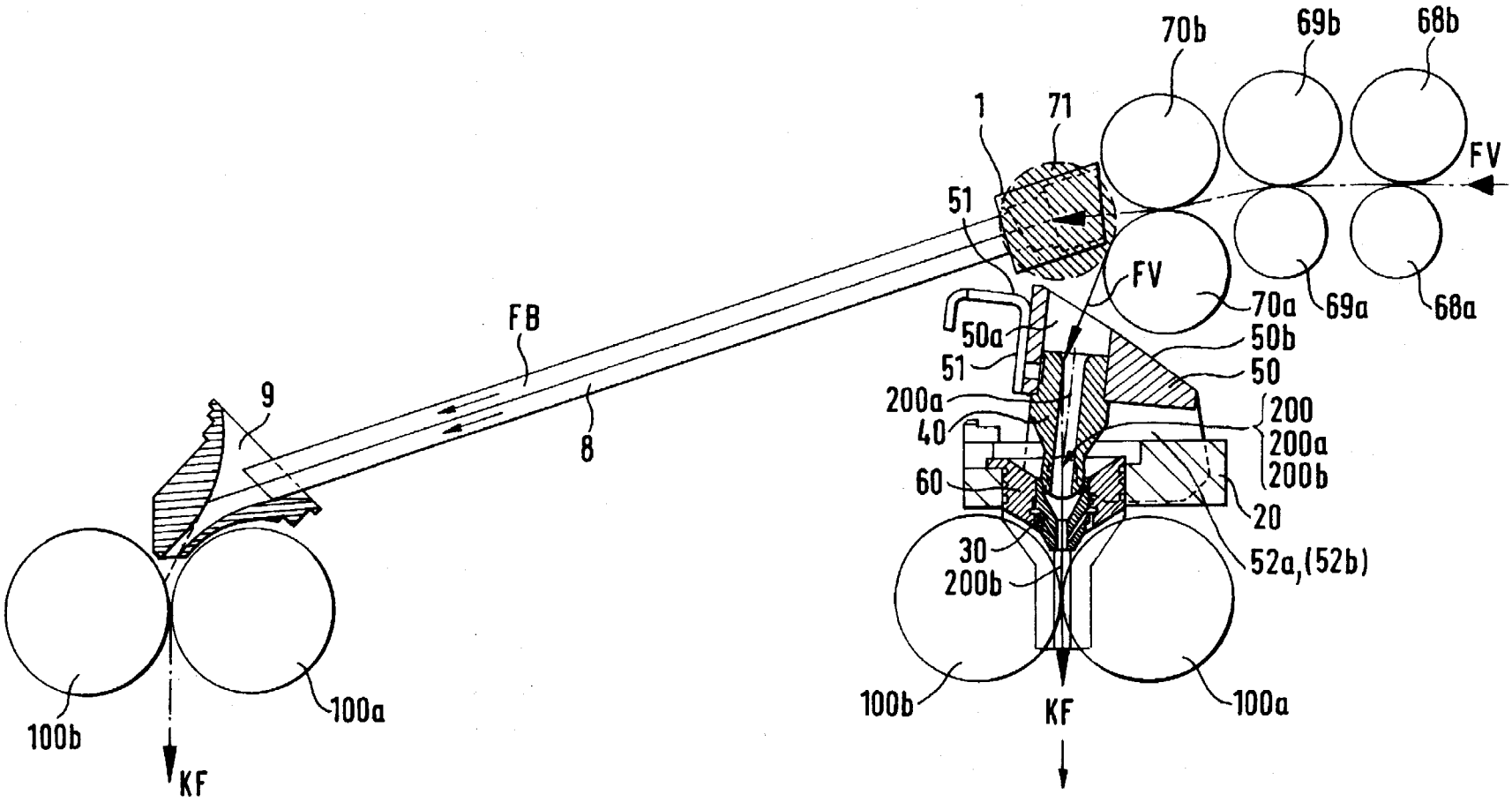
FIG. 1 is an overlay of a conventional configuration of a fiber sliver guidance with long fiber sliver channel over a configuration with joined nozzle inserts 30, 40, 50, 60 of which two nozzle inserts 40, 50 can be tilted around an axis V relative to the other two nozzle inserts 30, 60 which are installed on a fixed nozzle holder 20 located above the calendar disks 100*a*, 100*b*. The overlaid drawing serves to visualize the shortening of the traveling distance of the fiber sliver.

Reference will now be made in detail to the preferred embodiments of the invention, one or more examples of which are illustrated in the drawings. Each example is provided by way of explanation of the invention, and is not meant as a limitation of the invention. In fact, features illustrated or described as part of one embodiment can be used on another embodiment to yield a still further embodiment. Thus, it is intended that the present invention cover such modifications and variations as come within the scope of the appended claims and their equivalents.

Figure 2B:
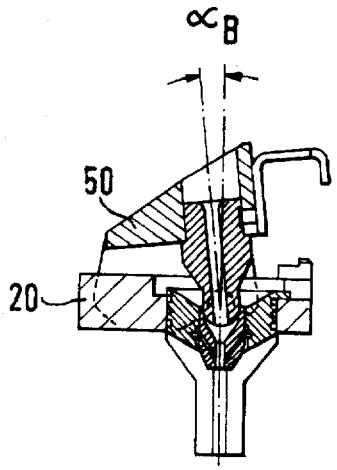
FIGS. 2*a* and 2*b* show two different swiveling positions αA, αB of the nozzles inserted into each other which are part of the overall nozzle insert, as examples of embodiments of the invention.
Figure 2A:
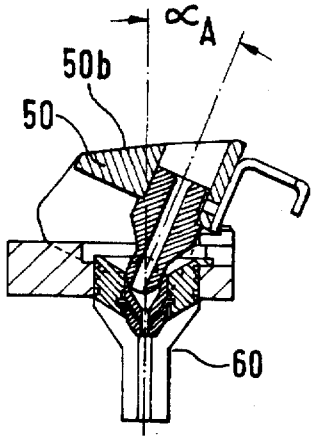
Figure 2:
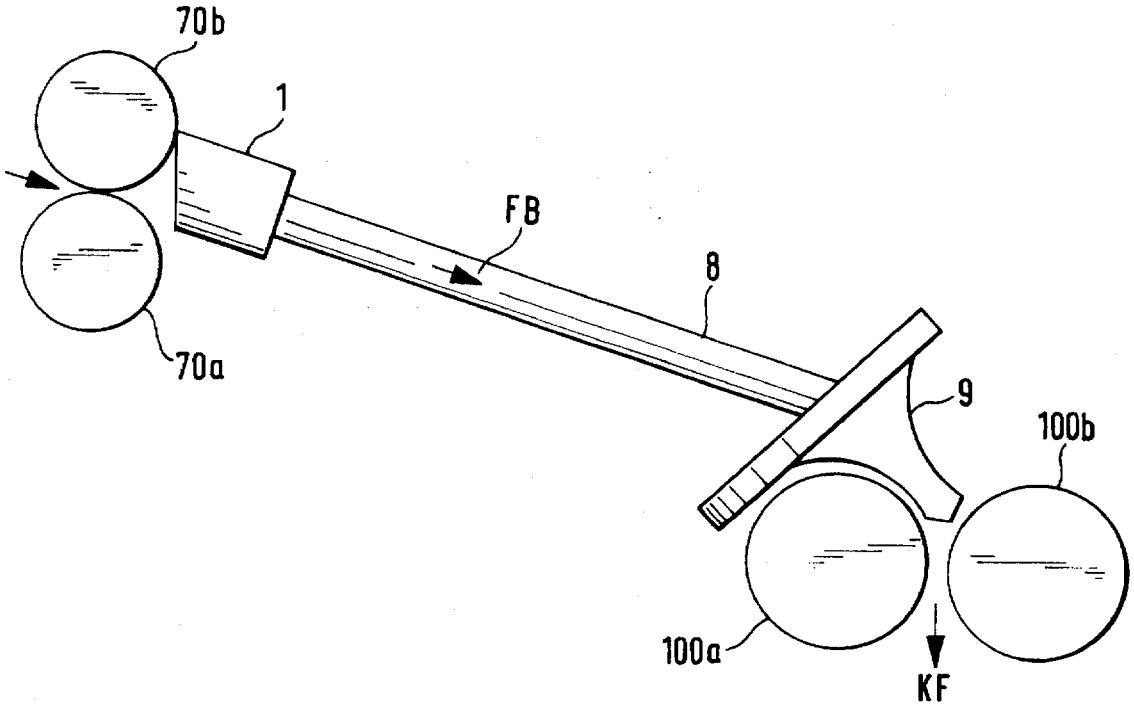
FIG. 2 is taken from EP 593 884 and again shows the fiber sliver guidance in the state of the art, with long fiber sliver channel 8, funnel channel 9 and calendar disks 100*a*, 100*b*. The fleece funnel is designated by 1 in FIG. 2 and the output rollers of the draw frame by 70*a*, 70*b*.

The overlay in FIG. 1 explains the difference between the state of the art which is shown schematically in FIG. 2. The fiber sliver FV which is not yet drafted as it is introduced into the drafting equipment is introduced via drafting rollers 68*a*, 68*b*, 69*a*, 69*b* and delivery rollers 70*a*, 70*b* into a fleece funnel in the state of the art, and from there into a long fiber sliver channel 8 which lets out in a sliver funnel 9. The sliver funnel deflects the fiber sliver FB by approximately 90° into the nip of the calendar with its calendar disks 100*a*, 100*b*. Hereinafter calendar disks or a pair of calendar disks are mentioned. This term also includes a pair of calendar rollers. This is possible because a pair of calendar rollers represents no restriction of the invention as compared with a pair of calendar disks.

The calendar fiber sliver KF emerges vertically down from the calendar disks and reaches a depositing device where it is deposited in a can (by means of a rotary plate which is not shown). This fiber sliver guidance system is given the same reference numbers also in FIG. 2.

In one embodiment of the invention, the fiber path is shortened and the fiber sliver channel 8 is omitted. An additional feed and deflection roller 71 causes a deflection of approximately 60° of the fleece conveying direction FV and introduces the fiber fleece into a fiber sliver channel consisting of several operational elements.

The first element is the fleece funnel 50 with a ramp surface 50*b* and a directly adjoining funnel section 50*a* in which the broad arriving fiber fleece is introduced in folded doubled form into a first channel section. The channel section is constituted by an insert 40 which is inserted on the rear of the funnel section 50*a* of the fleece funnel 50 and is attached by means of a screw. It can be adjusted.

A handle section 51 makes it possible to tilt the fleece funnel 50 so that the ramp surface 50*b* can be swivelled into the fiber sliver guide and the adjoining funnel section 50*a* can also be swiveled.

An articulation surface 41*a*, 41*b* (FIGS. 4*a* and 4*b*) is provided at the forward end of insert 40 and is shown in the angular position αB, which is shown in FIG. 1 or in FIG. 2*b*, and makes it possible to seal off the guiding channel from the downstream sliver funnel 30.

Figure 4A:
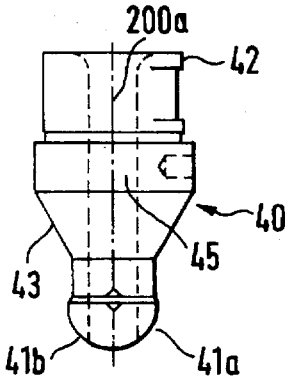
FIGS. 4*a* and 4*b* show a fleece funnel 50 with sliver funnel section 30 directly against it, both capable of swivelling together relative to a calendar guiding section 61.
Figure 4B:
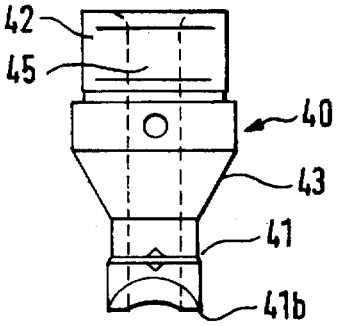

The articulation surface 41*a*, 41*b* of the forward, cylindrical section of the insert 40 which is symmetric relative to the central plane of the first insert 40 consists of two surface segments 41*a* and 41*b* tapering towards the rear (in axial direction) and are constantly curved, which engage a corresponding bearing surface 35 on the sliver funnel 30. FIGS. 4*a* and 4*b* show this articulation surface in two views at the forward end of insert 40 of the fleece funnel 50. Swiveling the fleece funnel 50 in direction α into the other angular position αA does not open the radial air-tight seal between fleece funnel and sliver funnel. In the closed position (αB) as well as in the open position (αA), radially air-tight fiber sliver guidance is achieved.

If the fleece funnel 50 is temporary, with an insert 40 capable of being inserted in opposition to the direction of fiber travel, the relative adjustment can be made on handle 51.

The fiber fleece is conveyed through the fleece funnel 50, the internal insert 40 and the sliver funnel 30 into the guiding channel and up to the nip 100*c*, and for this the fleece funnel 50 is swiveled out. The fiber fleece section F1 which has been narrowed down manually according to FIG. 3 and is held into funnel opening 50*a* is sucked in via injector bores 34*a*, 34*b*, 64*a*, 64*b* on the sliver funnel. A brief suction stream in the cylindrical channel 31 lasting around 500 ms is sufficient. The suction stream is produced with a minimum supply of compressed air going to the injection bores 34*a* and 34*b* in order to convey the narrowed section F1 of fiber fleece until it is in front of the nip 100*c*, as the articulation surface 35 and the bearing surfaces 41*a*, 41*b* of the internal insert 40 close radially in an airtight manner. No mechanical devices are needed for this introduction.

In order to convey section F1 of the fiber fleece with it the full width F of the now formed fiber sliver through the nip, a brief rotational impulse of duration $T_2$ is imparted the calendar disks. The suction stream is able to switch itself off after a predetermined suction time $T_1$, which can be superimposed on it or can be initiated separately and manually.

Figure 5A:
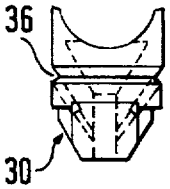
FIGS. 5*a*, 5*b*, 5*c* and 5*d* show the sliver funnel 30 for insertion into a holder 60 according to FIG. 6.
Figure 5B:
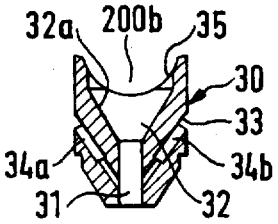
Figure 5C:
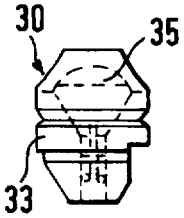

The form of the sliver funnel 30 can be seen clearly in FIGS. 5*a*, 5*b* and 5*c*. The direction and arrangement of the injection bores 34*a*, 34*b* in the sliver funnel are also shown enlarged in the figure. They let out into a cylindrical channel 31 which constitutes the forward end of the fiber sliver channel. The cylindrical section 31 widens over a conical section 32*a* to the diameter of channel 32 which is prescribed by the internal insert 40. The bearing surface 35 is provided at the upper end of the cone 32*a* and follows the curvature of the articulation surface 41*a*, 41*b*.

Figure 5D:
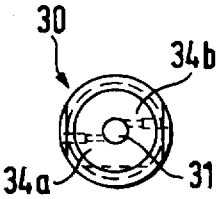

The two inclined injector bores 34*a*, 34*b* can also extend at an angle of approximately 45° from the axis 200*b* of the sliver funnel insert 30. They can let out advantageously in a common plane in the cylindrical section 31, be parallel offset in order to impart twist and additional strength to the introduced fiber sliver, in addition to the injector effect. FIG. 5*d* shows this arrangement. The injection bores start above a cylindrical section 33 of the insert 30 in a ring channel 36 open to the outside.

Figure 6A:
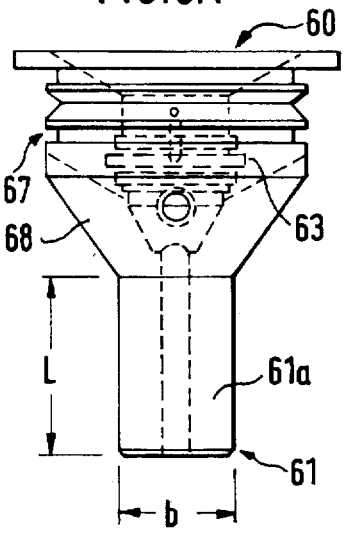
FIGS. 6*a*, 6*b* and 6*c* show the holder 60 in form of a beak funnel for the sliver funnel 30.
Figure 6B:
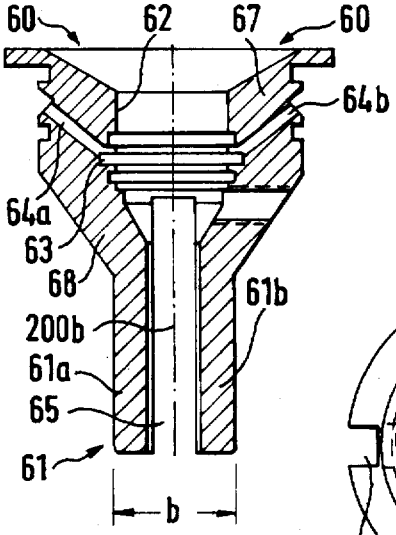
Figure 6C:
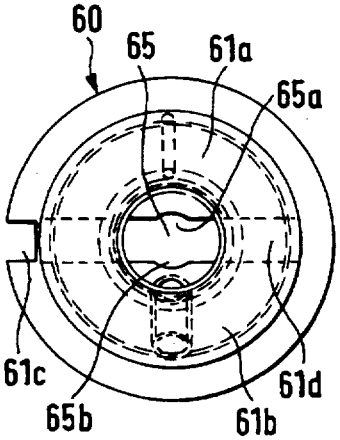

A sliver funnel holder 60, as in FIGS. 6*a*, 6*b*, 6*c*, has a central approximately cylindrical opening 2 in its upper approximately cylindrical section 67 in which the sliver funnel insert 30 is inserted. A ring channel 63, which can be supplied compressed air from two or more cylindrical bores 64*a*, 64*b*, is open to the inside and extends in circumferential direction in the cylindrical opening. The compressed air introduced from the outside is introduced starting from the ring channel into the inclined injection bores 34*a*, 34*b* while the sliver funnel insert 30 is inserted, to let out in the cylindrical section 31 of the fiber sliver channel located in close proximity of the nip 100*c*. The replaceability of the inserts 30, 40 makes it possible to switch over to different channel width because of different fiber sliver material when batches are changed.

Figure 7:
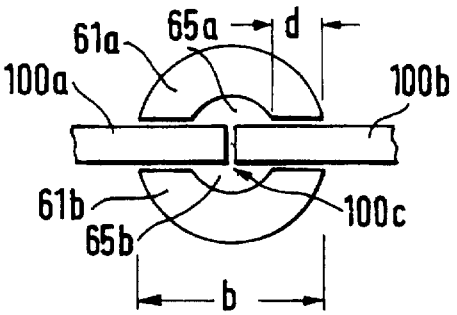
FIG. 7 shows a schematic top view of the nip 100*c* which is formed by the calendar disks 100*a*, 100*b*. The air channels 65*a*, 65*b* are delimited on the outside by the beaks 61*a*, 61*b* which are located at the front on the sliver funnel holder 60. This view is shown in detail in FIG. 6*c* without calendar disks.
Figure 7A:
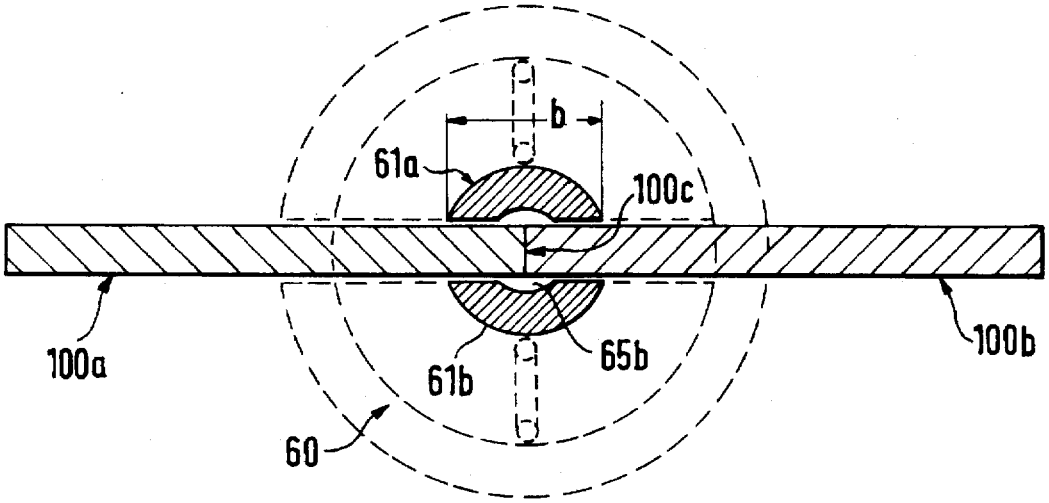
FIGS. 7*a* and 7*b* show in detail the nip shown schematically in FIG. 7, one time closed 100*c*, one time open 100*d*, by movement of one calendar disk 100*b* relative to the other.
Figure 7B:
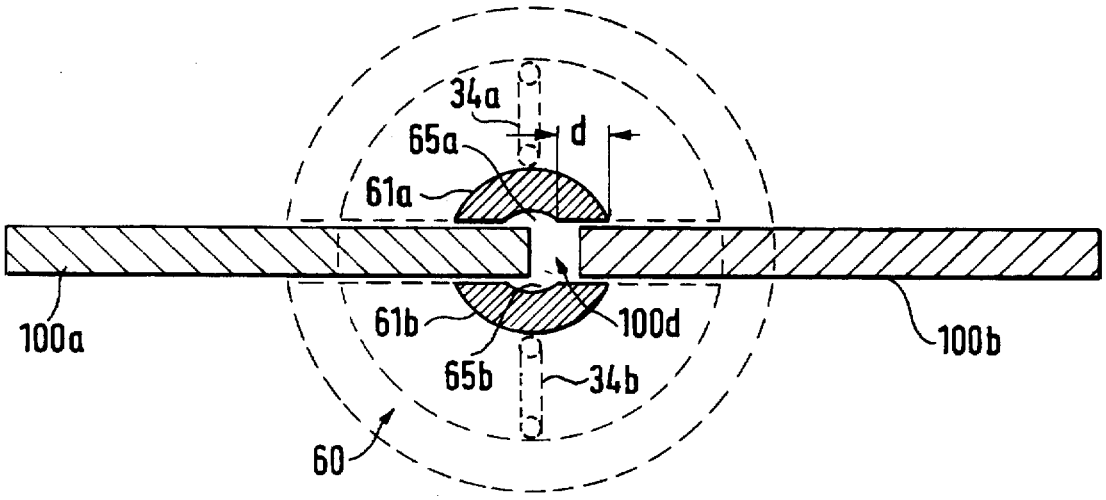

FIGS. 6*a* and 6*b* illustrate the cylindrical beak 61 of the sliver funnel holder 60 which follows a conical section 68 forming the transition between the upper, cylindrical end 67 and the beak 61. It has a length L and a diameter which in the cross-section of FIG. 6*b* is shown as width b. The beak 61 is fixed and has two halves since, as shown in FIG. 6*c*, it is slit laterally. As shown in the schematic drawing of FIG. 7, a segment of the rotating calendar disks 100*a*, 100*b* enters each of the two above-mentioned slits. This can be clearly seen in the right half also in FIG. 1. The nip is located in the center of the beak of the sliver funnel holder 60, i.e. in axis 22*b* of the fleece guiding system. This nip can be closed (nip 100*c*) as well as open (open nip 100*d*) through the position of one calendar disk (100*b*) as shown in FIGS. 7*a* and 7*b*.

The beak halves 61*a*, 61*b* which are attached in one piece and are formed by the above-mentioned slits 61*c*, 61*d* in the cylindrical beak 61 carry the conveying air past the nip 100*c* or 100*d*. The conveying air was previously introduced via injection bores 64*a*, 64*b* into the ring channel 63 and from there through the injection bores 34*a*, 34*b* of the sliver funnel 30 which extend at an angle to the axis 200*b* into the fiber sliver channel. The beak prevents the conveying air from escaping before nip 100*c*, 10*d*, and this air is instead conveyed beyond the nip until it is behind the nip. A first narrow channel section 65*a* on the one side of the calendar disks or a second narrow channel section 65*b* on the other side of the calendar disks serve to guide this air and have a nearly semi-circular cross-section. Each channel is very narrow as compared to the thickness d or width b of the beak 61 or of its inner wall which immediately adjoins the lateral surface of the calendar disk.

The width b of the beak and the covering d of the inside of the beak halves have a sealing effect relative to the calendar disk due to the lateral air guidance beyond the nip by means of the beak halves 61*a*, 6*b* which have a length L equal to approximately one half of the diameter of the calendar disks in the embodiment of the example, and this sealing effect is formed without contact by distinct to considerable lateral flow resistance relative to the axial lateral air channels 65*a*, 65*b*.

Although no contact is necessary between the beak halves 61*a*, 61*b* (the insides of the beak halves) and the rotating calendar disks, an almost exclusively axial air movement past the calendar nip is nevertheless enabled.

Only if the calendar nip 100*d* is open, as shown in FIG. 7*b*, is the air conveyed not only past the calendar nip, but clearly through the calendar nip. The conveying air is used to thread the fiber sliver immediately through the calendar nip and the calendar disk 100*b* can then be brought to bear (closed position) so as to reach operating position with the threaded fiber sliver. Also in this case, with the calendar nip open, the sealing surface (part of the covering d) is sufficiently large relative the air resistance of the now enlarged passage channel consisting of channel segments 65*a*, 65*b* and the open calendar nip 100*d*, in order to avoid radial escape of the conveying air.

Figure 8B:
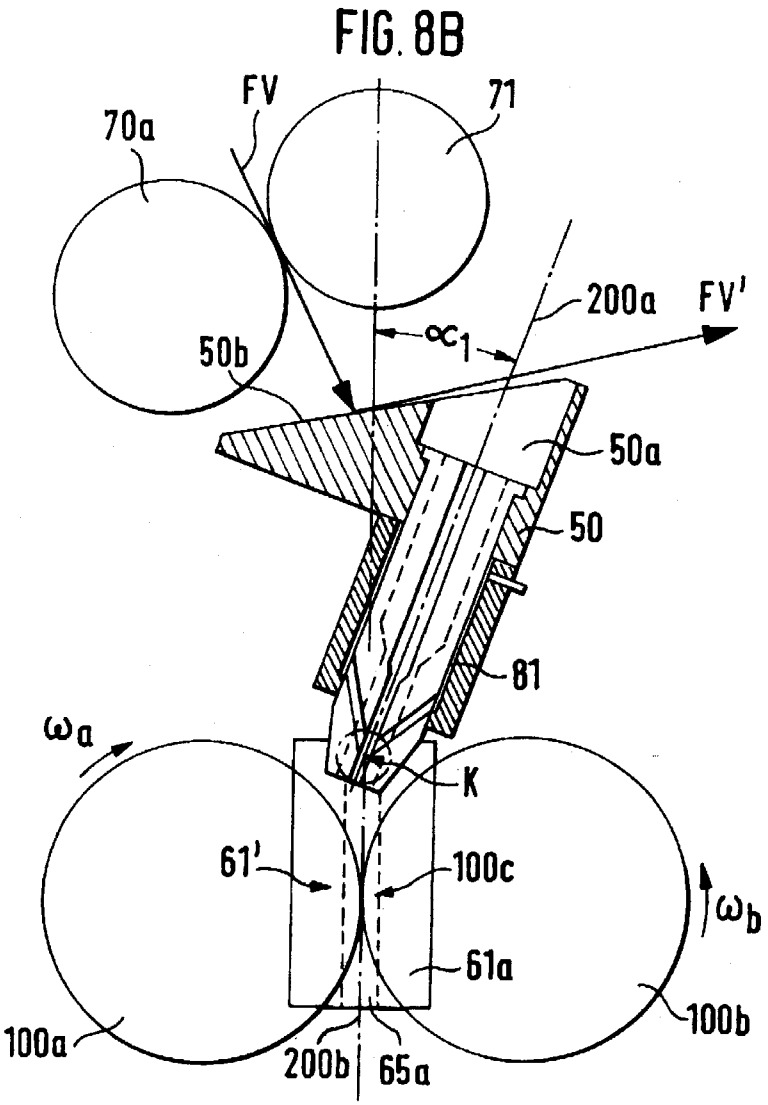
FIGS. 8*a* and 8*b* show an embodiment comparable to FIGS. 3*a*, 3*b* in which the swivelling zone has at the same time the curve K in the guiding axis 200*a*, 200*b* of the fiber sliver guidance. A calendar guiding section remains as a fixed section 61' below the axis curve K. Across from it, all the functioning nozzle elements—also the sliver funnel area—between delivery rollers 71, 70*a*, 70*b* and calendar disks 100*a*, 100*b* can be swiveled. The area above the section 61' is made in one piece in the form of insert 40, 30 in the fleece funnel 50, surrounded by a cylindrical holder 80.
Figure 8A:
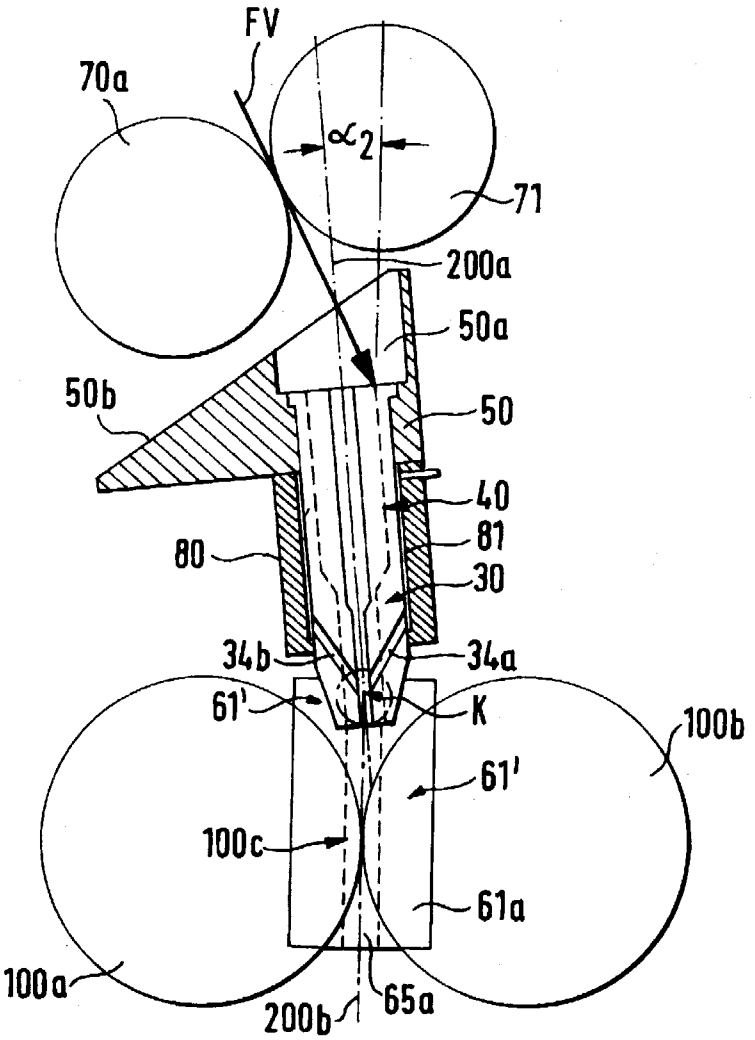

FIGS. 8*a* and 8*b* show a configuration of a guiding section made essentially in one piece and containing the fleece nozzle 50 as well as the sliver funnel 30. The sliver funnel 30 is here inserted directly into the fleece nozzle 50 and is in addition fixed in its position by a pipe holder 80. The forward end of the sliver funnel 30 is supported in bearing cups and rounding surfaces comparable to those described through FIGS. 4*b* and 5*c* for the fleece funnel insert 40.

The radial seal is thus also achieved in FIGS. 8*a* and 8*b*, where a remaining guide section 61' is installed fixedly relative to the calendar disks, e.g. on the holder 20 as shown in FIG. 9*a*. The remaining guiding section 61' corresponds to the beak area L of the sliver funnel holder 60 of FIG. 6*a*. In this embodiment, the air is introduced via inclined injection bores 34*a*, 34*b* into the combined fleece funnel/sliver funnel at its forward end, whereby a swiveling motion results in slight swiveling of the air introduction, but which is only minimal due to the center of gravity K in its vicinity.

Figure 3:
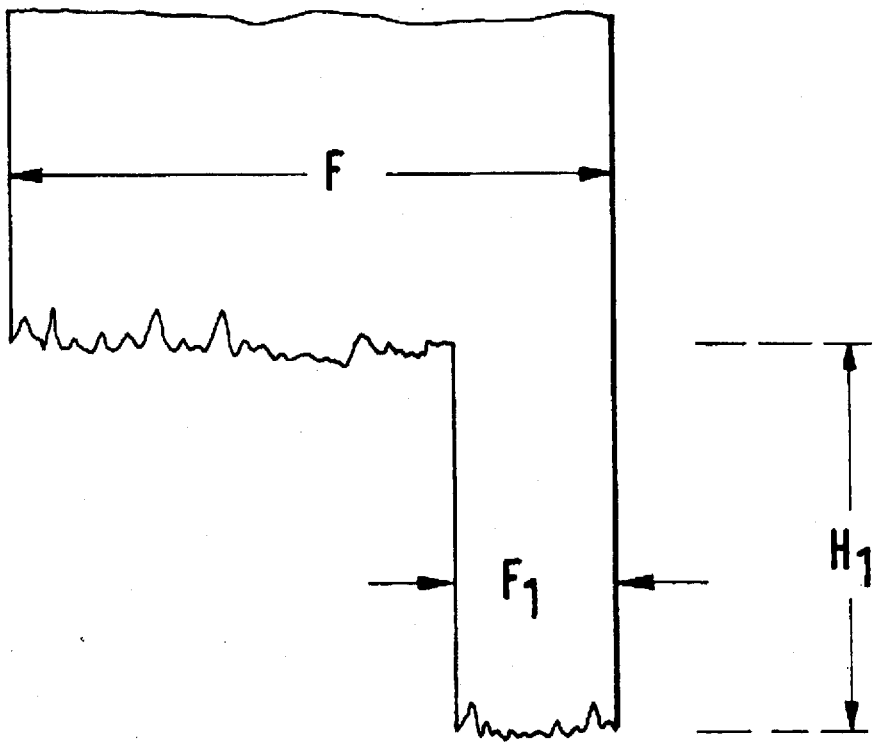
FIG. 3 shows a prepared beginning of a fiber fleece for introduction into fleece funnel 50.
Figure 3B:
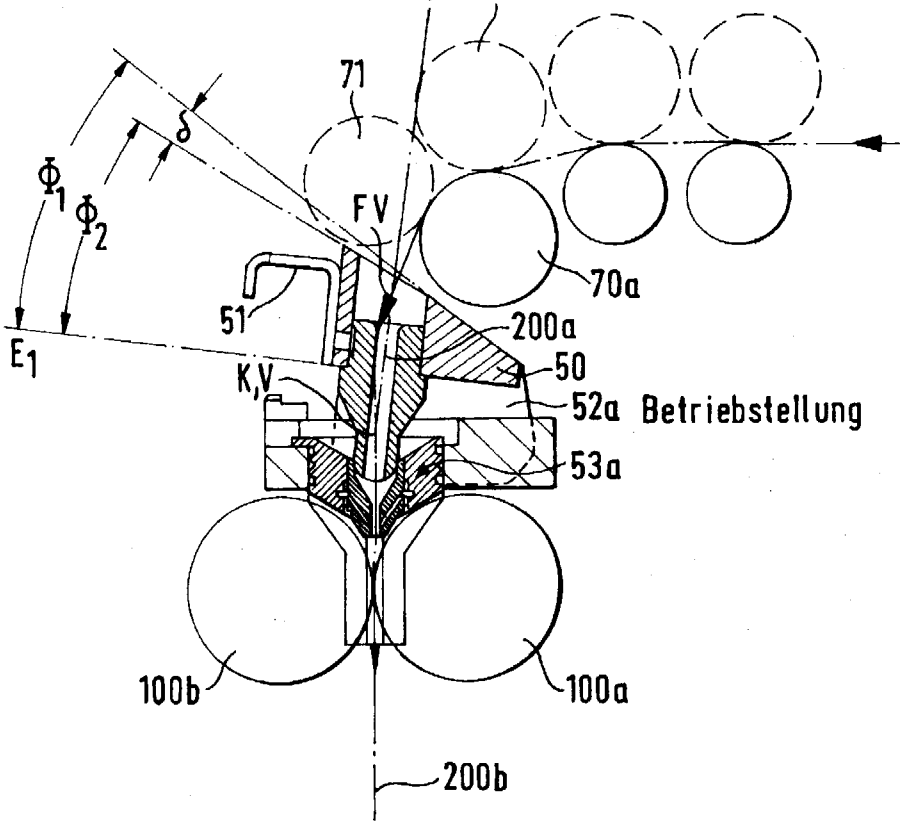
FIGS. 3*a* and 3*b* show the two tilt positions for fiber fleece introduction (back-up position) and in operation of the draw frame.
Figure 3A:
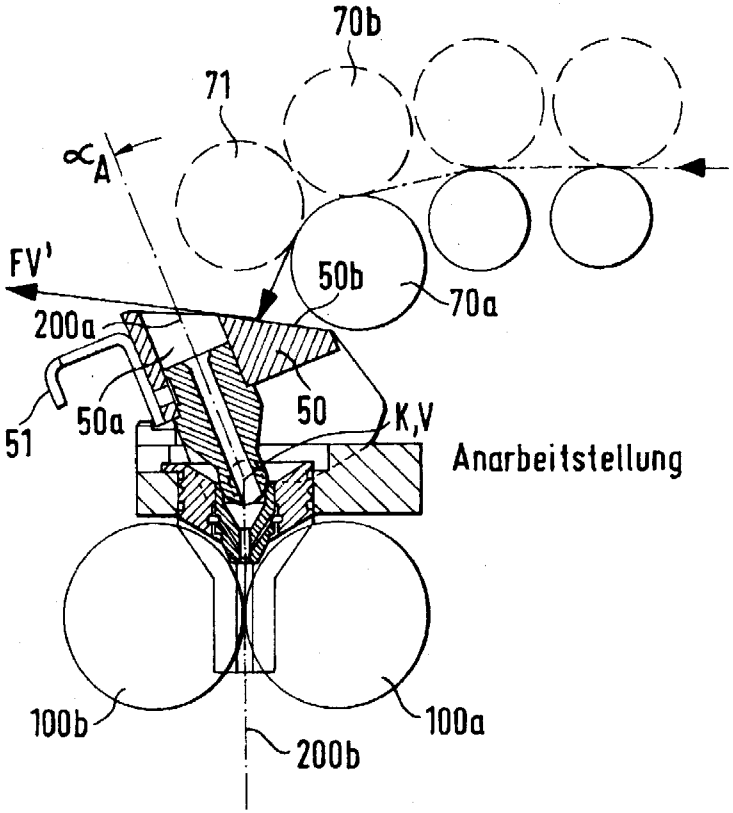

The two swivel positions shown in FIGS. 8*a* and 8*b* are designated α1 and α2, but can be given slightly different dimensions, since the swiveling part in FIGS. 8*a* and 8*b* is larger or longer than in FIGS. 3*a* and 3*b*.

The different bores and corresponding conical transitional sections are defined in the fiber sliver conveying sections in insert 40 which is at the same time fleece funnel insert and sliver funnel 30. A change of insert 40 is at the same time a change of the sliver funnel 30. Readjustment or leveling can be omitted because of the one-piece construction.

The ring-shaped holder 80 is in not entirely flush contact with the combined fleece funnel/sliver funnel, but leaves an annular clearance 81 between the inside of the funnel and the outer circumference of the mostly cylindrical combination funnel 30/40. The annular clearance 81 guides the compressed air used for fiber conveying and is sealed at the front end by flush (annular) contact against the combination nozzle—below the injection bores 34*a*, 34*b*. A main air supply line letting out into the annular clearance 81, able to build up compressed air therein and feeding the injection bores 34*a*, 34*b* is located at a suitable level which can be selected in function of the application.

The injection bores are clearly inclined relative to axis 200 also in this example, and they let out directly before the radially air-tight articulation at the curvature point K where radial, air-tight support is provided in both positions shown in FIGS. 8*a* and 8*b*.

The angles α1 and α2 are slightly smaller than in the example of FIGS. 2*a* and 2*b*, but are within the same range as indicated in FIG. 2. The precise angle in this embodiment is approximately 5° for α2 and approximately 25° (±10%) for α1, while in FIG. 2*a* an angle αA of approximately 30° and in FIG. 2*b* an angle of approximately 7° (±10%) have worked well in experiments.

The plateau area 50 in FIGS. 8*a* and 8*b* is accordingly adapted relative to the angle of the ramp area 50*b* in FIGS. 2*a* and 2*b*. It hangs together with the angles α in the respective swiveling end positions, with the swivel positions α1 and α2 imparting such an angle to the ramp that the direction of movement of the fiber fleece FV from the output area of the draw frame is distinctly at a right angle. It is most advantageous here for the right-angle direction of FV to contain a slight downward component, i.e. is slightly inclined downward relative to the horizontal.

For this purpose the ramp area is given either a slight slope of 1° to 2° relative to the funnel area, or is slightly conical.

Two different guiding channel dimensions are represented in the combination funnel 30/40 in the FIGS. 8*a* and 8*b*. One is narrow and one is wide, each with a conical extension directed towards the narrowest cylindrical channel section.

FIGS. 9*a* and 9*b* show a lateral view and top view of the fleece funnel 40 with its ramp area 50*b* and its funnel area 50*a* according to FIG. 3. The swivel axis V is at a right angle to the guiding axis 200*a*, 200*b* and extends through the air-tight articulation 41*a*, 41*b* as shown in FIGS. 4 and 5. At the same time the swivel axis V extends through the bearings 50*c* which are formed by lateral holding brackets 52*a*, 52*b* and journals which can be set on the forward swivel seats which are at least half open. The fleece funnel 50 can thus be removed and tilted while the guiding channel 200*a*, 200*b* on the inside remains air-tight.

FIGS. 9*a* and 9*b* show the swiveling fleece nozzle 50 with ramp segment 50*b* and funnel area 50*a*. The swivel axis V is drawn in and is defined by an articulation shown schematically on the right side next to FIG. 9*b*. A bearing tab 52*a* (52*b* on the opposite side) is provided with an approximately semi-circular opening open towards the bottom which is placed on a journal 50*c* to constitute an articulation. Due to the gently transitions at the opening end of the opening 53*a* (53*b* at the opposite end), the fleece funnel 50*c* can be removed and re-installed easily. The direction of arrow F indicates this. At the same time the fleece funnel 50 can swivel by the angle α, this swiveling being produced either by a user at the handle 51, or by a fleece back-up and the back-up pressure produced above the swivel axis V so that the ramp area 50*b* is swivelled in the direction of travel of FV.

The width of the ramp area 50*b* is e and is approximately as wide as the inlet area of the funnel segment 50*a*. It can easily be made conical and it can be at an angle Φ, relative to the plane $E_1$ which is perpendicular to axis 200*a* of the fiber sliver channel (see also FIG. 3*b*). The inclination $\Phi_1$, is adapted to the swiveling angle αA which occurs as end position (preparation position) as the fleece funnel swivelled out. In this case, the fleece conveying direction FV' should lead out of the area of the drafting equipment at an angle of approximately 90°. Accordingly an angle of approximately 30° (20° to 40°) is selected in practical application.

The inlet area of the funnel segment 50*a* is at a somewhat smaller angle $\Phi_2$ with the plane $\Phi_1$. The difference Φ between these two angles is between 1° and 5°.

The design of the fleece funnel achieves improved, i.e. constant rolling up, of the fleece as the sliver is introduced into the guiding section.

At the same time the machine is secured against downtimes due to the fact that the fleece funnel swivels out automatically and conducts the continued running of the fiber sliver into the outer zone of the machine, where the fiber sliver which no longer properly drafted can be removed easily.

Service times are shortened and simplified. The ramp 50*b* of the fleece funnel provides a preparation position in addition to the back-up position, without the need for the user to first unthread the fiber sliver from the drafting equipment area. This takes place automatically.

In combination with the relief of the upper roller in case of lap formation, the fleece nozzle ramp 50b closes the possible clearance to uncontrolled fiber/fleece travel and thereby prevents lap formation. The machine can be monitored electrically.

It will be apparent to those skilled in the art that various modifications and variations can be made in the present invention without departing from the scope and spirit of the invention. It is intended that the present invention cover such modifications and variations as come within the scope of the appended claims and their equivalents.

We claim:

1. A fiber sliver guidance system for a textile machine drafting equipment wherein a fiber sliver is drafted by pairs of drafting rollers and conveyed by a pair of delivery rollers to a calendar device, said guidance system disposed between said delivery rollers and said calendar device and comprising:

a plurality of interconnected nozzle inserts defining an essentially air tight conveying channel between said delivery rollers and said calendar device, said channel having an axis defined by two axial segments which can be angled relative to each other;

at least one of said nozzle inserts being articulatable relative to said other nozzle inserts about a swivel axis, said articulatable nozzle insert defining one of said axial segments; and wherein said articulatable nozzle swivels automatically from an operating position to a closed position upon a back up of fiber fleece in said fiber sliver channel, in said closed position said articulatable nozzle deflects said fiber fleece still produced by said drafting equipment from an operating conveying path through said fiber sliver channel to an area so as to keep said drafting equipment operationally unblocked.

2. The system as in claim 1, wherein said swivel axis extends essentially perpendicular to said fiber sliver channel.

3. The system as in claim 1, wherein said articulatable nozzle insert is interlockingly engaged with an essentially air tight seal with its adjacent said nozzle insert at said swivel axis.

4. The system as in claim 1, further comprising an articulation surface defined on a stationary said nozzle insert operably downstream from said articulatable nozzle insert, said articulatable nozzle insert comprising an articulation surface complimenting said stationary nozzle insert articulation surface.

5. The system as in claim 1, wherein said articulatable nozzle insert is directly adjacent said delivery rollers and comprises a funnel section and a ramp section which are moved alternately to a position below said delivery rollers upon swivelling of said nozzle insert from its said operating position to said closed position.

6. The system as in claim 1, further comprising a deflection roller operably disposed between said delivery rollers and said fiber sliver channel, said deflection roller disposed to deflect said fiber fleece in its conveying path to said fiber sliver channel.

7. The system as in claim 6, wherein said deflection roller deflects said fiber fleece generally in a range of twenty to ninety degrees.

8. The system as in claim 1, wherein said articulatable nozzle insert comprises a funnel adjacent said delivery rollers which receives fiber fleece emerging from said drafting and delivery rollers and rolls and gathers said fleece together in said operating position.

9. The system as in claim 8, wherein said funnel further comprises a ramp section that automatically swivels to said closed position relative to said delivery rollers upon a fleece back up, in said closed position said ramp section deflects said fiber fleece from its operational conveying path away from said drafting equipment.

10. The system as in claim 9, wherein said ramp section deflects said fiber fleece in said closed position approximately ninety degrees from said operational conveying path.

11. A swivelling fleece nozzle for insertion into a fiber sliver guidance system having two axial segments for a textile machine drafting equipment wherein a fiber sliver is drafted by pairs of drafting rollers and conveyed by a pair of delivery rollers to a calendar device, said fleece nozzle 15 adapted to be movable in said sliver guidance system relative to one axial segment from an operating position wherein fiber fleece is received from said drafting and delivery rollers and conveyed through a fiber sliver channel to a closed position wherein said fiber fleece is deflected from said fiber sliver channel, said fleece nozzle further comprising a funnel section for receiving and rolling said fiber fleece in said operating position and a ramp section for deflecting said fiber fleece from an operating conveying path in said closed position.

12. The nozzle as in claim 11, wherein said ramp section forms an angle of about twenty degrees to forty degrees relative to a longitudinal axis through said funnel section, said ramp section having a width at a right angle to said conveying direction of said fiber fleece at least as wide as an inlet section of said funnel section.

13. The nozzle as in claim 11, wherein said ramp section swivels to a position at said closed position so that said ramp section deflects said fiber fleece in a direction of about ninety degrees from its conveying direction in said operating position.

14. A process for guiding fiber fleece from drafting and delivery rollers of textile drafting equipment through a fiber sliver channel to a calendar device wherein the fiber fleece is automatically deflected from the drafting equipment upon a back up of the fiber fleece in the fiber sliver channel, said process comprising conveying the fiber fleece through a fiber sliver channel formed of at least two axial air tight interconnected segments wherein, upon a back up of fiber fleece in said fiber sliver channel, at least one of the axial segments automatically swivels from an operating position wherein fiber fleece is conveyed through said fiber sliver channel to a closed position wherein the fiber fleece is deflected away from the drafting equipment.

* * * * *